US005351641A

United States Patent [19]

Robson

[11] Patent Number: 5,351,641

[45] Date of Patent: Oct. 4, 1994

[54] BOAT HULL CONSTRUCTION

[76] Inventor: Scott Robson, 24A Creyke Road, Fendalton, Christchurch, New Zealand

[21] Appl. No.: 15,483

[22] Filed: Feb. 9, 1993

[51] Int. Cl.[5] ..... B63B 1/32

[52] U.S. Cl. ..... 114/288; 114/61

[58] Field of Search ..... 114/61, 288, 289, 290, 114/291, 148, 56; 440/69

[56] References Cited

U.S. PATENT DOCUMENTS

| | | | |
|---|---|---|---|
| 1,712,281 | 5/1929 | Royer | 114/289 |
| 2,666,406 | 1/1954 | Babcock | 114/61 |
| 3,470,839 | 10/1969 | Faul et al. | 114/61 |
| 3,761,980 | 10/1973 | Silverstein | 9/310 |

FOREIGN PATENT DOCUMENTS

| | | | |
|---|---|---|---|
| 1052307 | 1/1954 | France | 114/291 |
| 1-18793(A) | 1/1989 | Japan . | |

*Primary Examiner*—Jesus D. Sotelo

*Attorney, Agent, or Firm*—Pennie & Edmonds

[57] ABSTRACT

The present invention is an improved boat hull construction, in particular for power catamarans. The individual hulls incorporate step breaks to define individual planing sections with different constant deadrise angles. Twist or warp is thereby eliminated in these sections, reducing drag and increasing efficiency. The step breaks also allow individual outboard chine flats which reduce in width from aft to fore. The catamaran tunnel features a decreasing section to compress air and provide a cushioned ride.

22 Claims, 9 Drawing Sheets

BOAT HULL CONSTRUCTION

BACKGROUND OF THE INVENTION

The present invention relates to boat hull constructions and, more particularly, an improved catamaran hull construction.

Catamaran hull constructions in general are well known in the art. There are two distinct hull forms frequently used in pleasure and commercial catamarans: symmetrical and asymmetrical. Typical catamaran hulls for power craft have relatively high and wide tunnels with a constant shape. The tunnel is shaped in an effort to prevent waves from slamming into the tunnel roof and to prevent the hull from sucking on the water at low speeds. As a result, such craft tend to be wide, high and bulky in appearance.

Not only is the tunnel shape important in the design of a catamaran, the shape of the individual hulls also effects the performance of the craft. As is well known in the art, every hull design is a compromise to some degree. For example a low deadrise angle results in a high efficiency, hard ride; whereas a high deadrise provides a low efficiency, soft ride. Hull constant section and entry also effect performance in a similar manner. A long constant section and full entry leads to a high efficiency hull with better following sea performance and hard ride in a head sea. A short constant section and fine entry provides soft ride in a head sea and lower efficiency hull, but with the trade-off of a poorer following sea handling.

The skilled designer must address these compromises when designing hulls for particular uses. However, the art has heretofore failed to recognize that by a unique combination of design elements, as described hereinbelow for the present invention, a soft ride, good efficiency, sea kindness with a lower silhouette and overall more pleasing appearance can be achieved.

SUMMARY OF THE INVENTION

It is thus an object of the present invention to provide an improved hull construction which provides a superior combination of ride, efficiency, sea kindness and overall appearance.

It is a further object of the present invention to minimize the compromises in performance and appearance previously required in hull design.

Another object of the present invention is to provide a catamaran hull with a modified tunnel and thus improved performance.

Yet another object of the present invention is to incorporate into a new catamaran hull both the improved hull construction and modified tunnel to achieve even greater performance improvements.

These and other objects are achieved according to the invention by a boat having two spaced-apart hulls, a boat body positioned on the hulls and a tunnel formed on three sides by the body and hulls and on a fourth and a bottom side by the water in which the boat is positioned. The tunnel defines a mouth at the bow of the boat and an exit at the stern. The distance between the spaced-apart hulls defines a tunnel width which decreases from the mouth to the exit. The boat body further defines a tunnel roof at a decreasing height above the waterline from the mouth to the exit.

In a preferred embodiment, the tunnel width at the mouth is approximately two times or more greater than the tunnel width at the exit, and decreases from the mouth to amidships and is substantially constant from amidships to the exit. Also, preferably, the tunnel height at the mouth is approximately two and one-half times or more greater than the height at the exit.

In a further preferred embodiment, the boat hull comprises an aft planing section, a mid planing section and a fore planing section. Each section disposed adjacent to the next from aft to forward along the hull. A first step break is disposed between the aft and mid planing sections and a second step break is disposed between the mid and fore planing sections. The aft section defines first a constant deadrise angle and the mid section defines a second constant deadrise angle greater than the first constant deadrise angle, such that the deadrise angle of the hull increases from the aft through the mid sections without twist or warp which increase drag and decreases efficiency. The fore section defines at least a third deadrise angle greater than the first and second deadrise angles.

In a further preferred embodiment, the hull defines an inboard portion and at least one outboard portion, said portions extending longitudinally along substantially the length of the hull. Each planing section as described above defines, along the outboard portion, a chine flat and, along the inboard portion, a keel flat.

The aft section chine flat extends from the transom, at a predetermined width, to a location aft of the first step break, with the width reducing therealong. The mid section chine flat extends from the first step break, at a predetermined width, to a location aft of the second step break, also reducing in width therealong. The fore section chine flat extends from the second step break forward. Preferably, the aft section chine flat and the mid section chine flat reduce in width substantially to a point with substantially no width at the ending locations aft of the step breaks.

DETAILED DESCRIPTION OF THE PREFERRED EMBODIMENT

Figure 1:
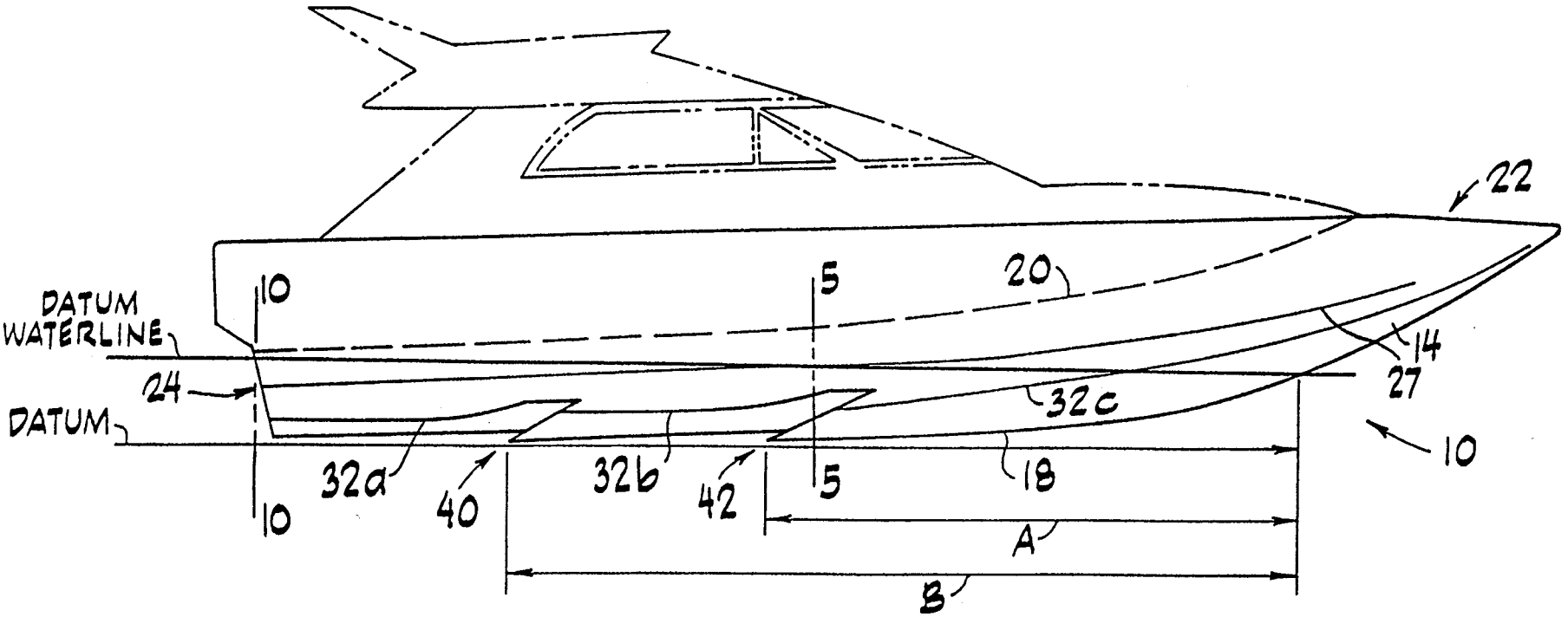
FIG. 1 is side elevation of the starboard side of a boat utilizing the hull construction of the present invention.
Figure 2:
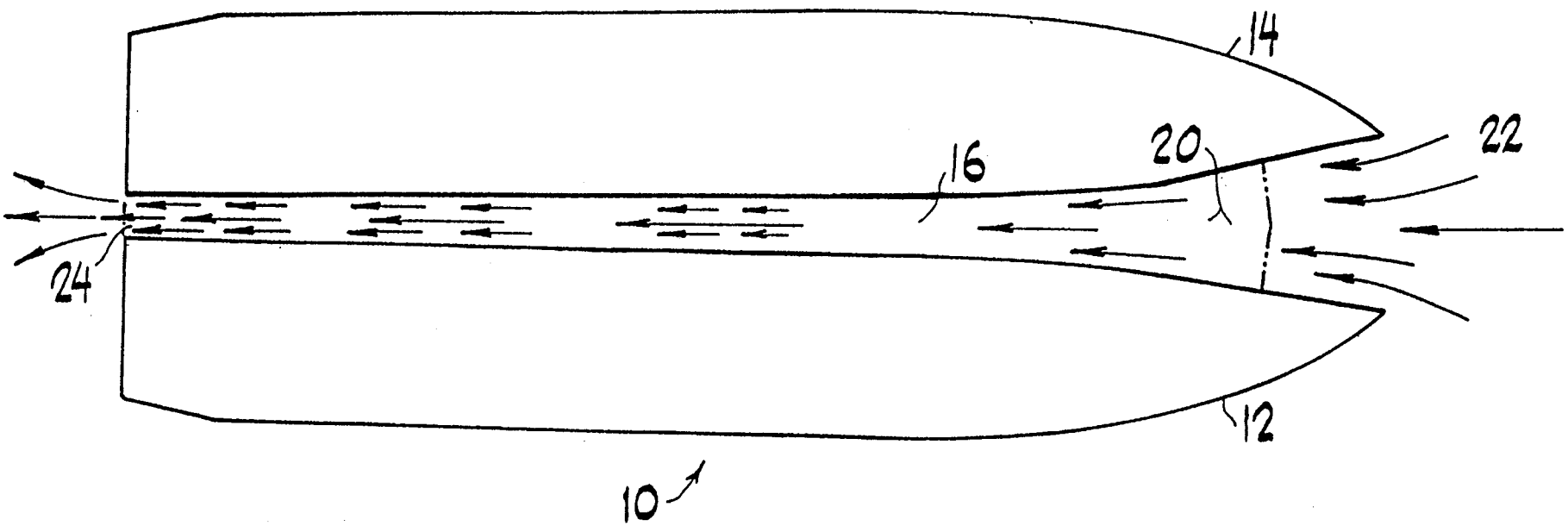
FIG. 2 is a schematic bottom plan view of a hull construction according to the inventions.
Figure 3:
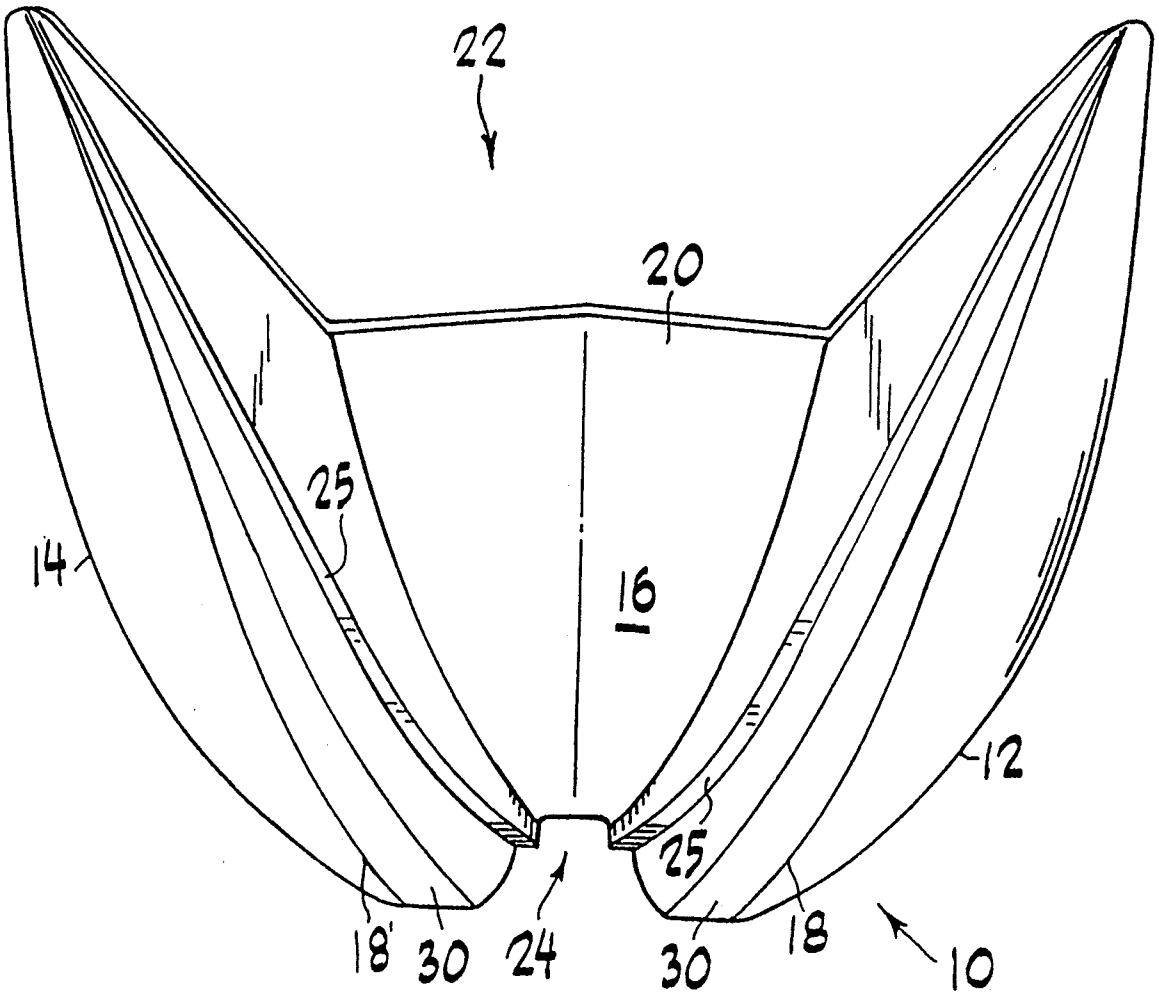
FIG. 3 is a front perspective view, looking aft, of the hull construction of FIGS. 1 and 2.

Two overall features of the present invention, which contribute to achievement of the objects of the invention, are the tunnel shape and the hull shape. Referring first to FIGS. 1 and 2, it can be seen that the catamaran hull 10 according to the invention comprises generally port hull 12 and starboard hull 14, with tunnel 16 disposed therebetween.

Tunnel 16 of the present invention differs from tunnels in prior art power catamarans in that it is lower and narrower in the area from amidships to the transom. Tunnel 16 further features a wedging from keel 18 to tunnel roof 20 and a tapering from a wide mouth 22 to tunnel exit 24 at the transom. Tunnel 16 of the present invention overcomes prior art problems of appearance, slamming and suction as discussed above. This is accomplished by the combination of wedging and tapering of the tunnel. Wedging refers, longitudinally, to the decreasing distance between the tunnel roof 20 and keel 18 from fore to aft (See FIG. 1) and, transversely, to the narrowing of the tunnel width from the bottom to the tunnel roof (See FIG. 10). Preferably the tunnel is about two and one-half times higher at mouth 22; as compared to at exit 24. However, depending on desired performance it may be varied slightly more or less. Preferably the tunnel wall is angled in two steps as shown in FIGS. 6–10, with a first angle from the bottom to inside chine 25 and a second angle to the tunnel roof. Tapering refers to the decreasing width of the tunnel from fore to aft, wherein the width of the tunnel at mouth 22 is at least approximately twice the width of the tunnel at exit 24, which also may be varied slightly.

Due to the tunnel shape, the craft generates positive lift through the entire speed range by drawing an air and water mix into the relatively wide and high tunnel mouth 22 and compressing it to create an air cushioned ride. Lift is further provided by inside chines 25 and outside chines 27. Slamming and suction are avoided regardless of the roughness of the seas so long as tunnel roof 20 has a height off the water line equal to at least about 25% of the total immersion of the hull. Due to the wedge shape and taper, the mix of air and water drawn into the tunnel through the mouth also allows the craft to carry a heavier loads. Load capacity is increased because as the hull is immersed in the water, it gains more displacement area for planing; yet as the load is lightened, the craft will climb higher in the water, thus reducing drag by removing non-essential planing area from the water.

Figure 4:
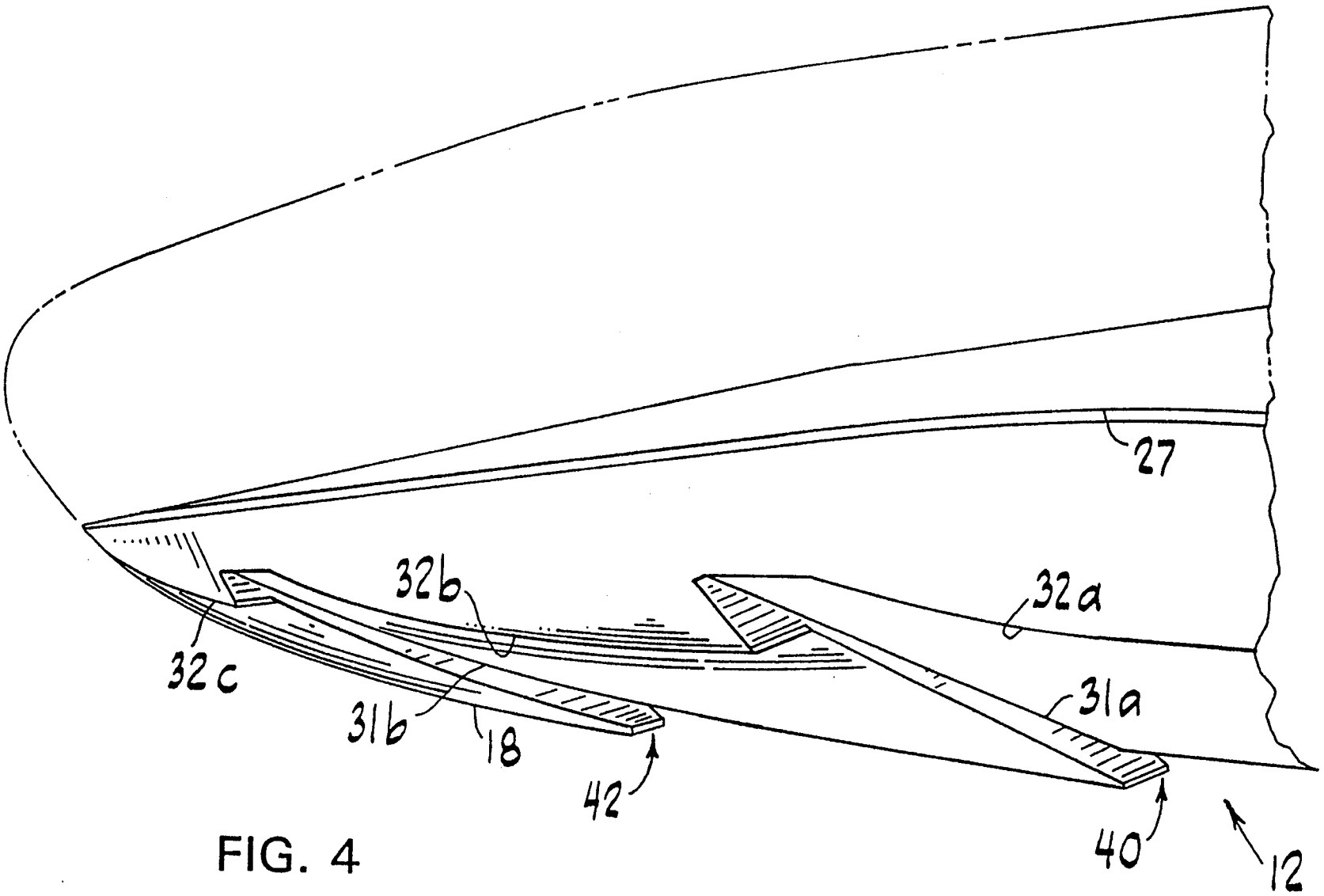
FIG. 4 is a partial perspective view of the outboard side of a port hull according to the present invention, showing typical step breaks and chine flats.
Figure 5:
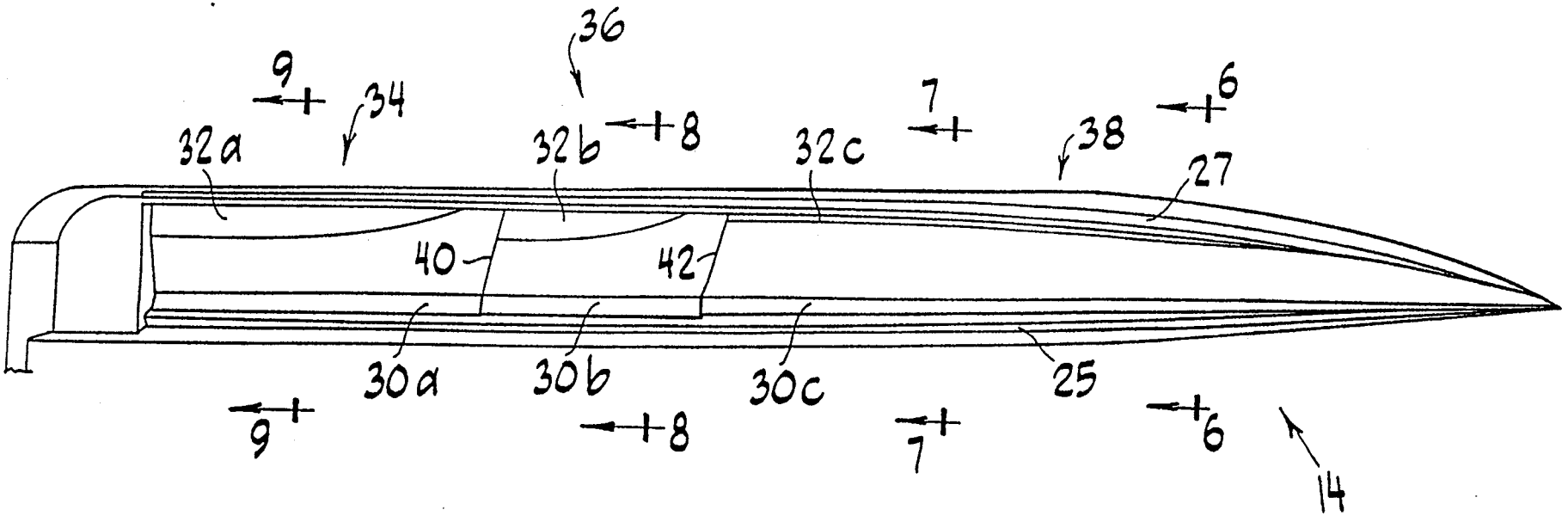
FIG. 5 is a bottom plan view of a starboard hull according to the invention.

The unique shape of the individual hulls 12 and 14 (FIGS. 4 and 5) further improve the performance of craft. As shown in FIG. 5, each hull has keel flats 30*a,b,c,* and chine flats 32*a,b,c.* These flats are of substantial width between the transom and amidships (a and b) and reduce relatively quickly in width as they go forward (c). The hulls further feature a multi-deadrise constant section hull shape with two transverse step breaks 40 and 42. This combination of features reduces the compromises required in prior art hull designs.

Figure 6:
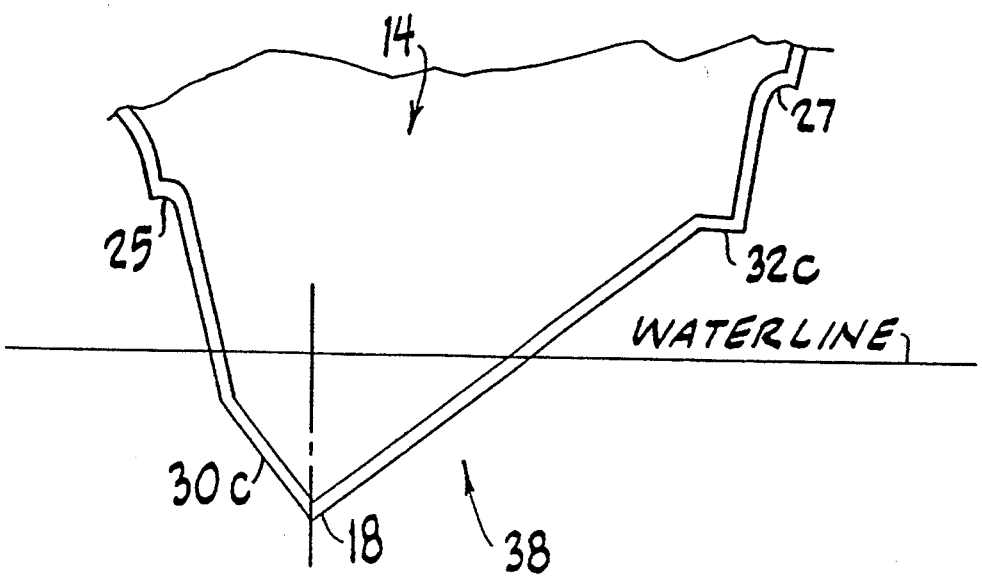
FIGS. 6, 7, 8 and 9 are schematic section views through lines 6—6, 7—7, 8—8 and 9—9, respectively of FIG. 5.
Figure 7:
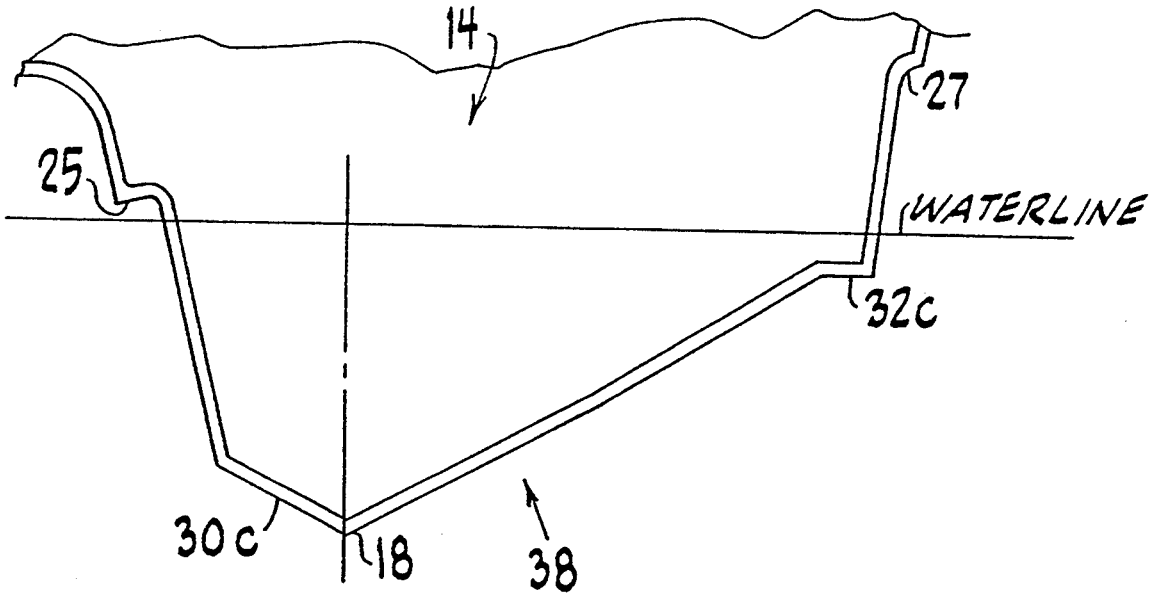
Figure 8:
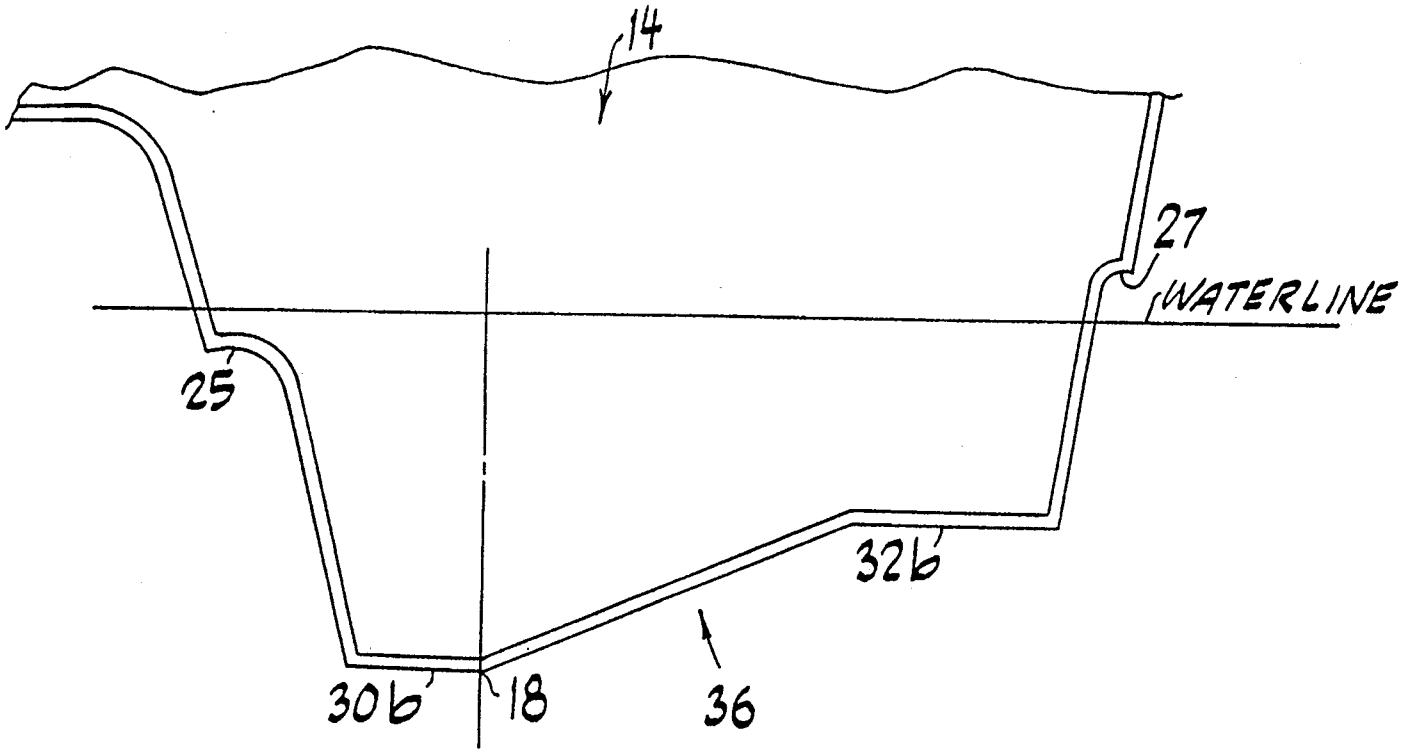
Figure 9:
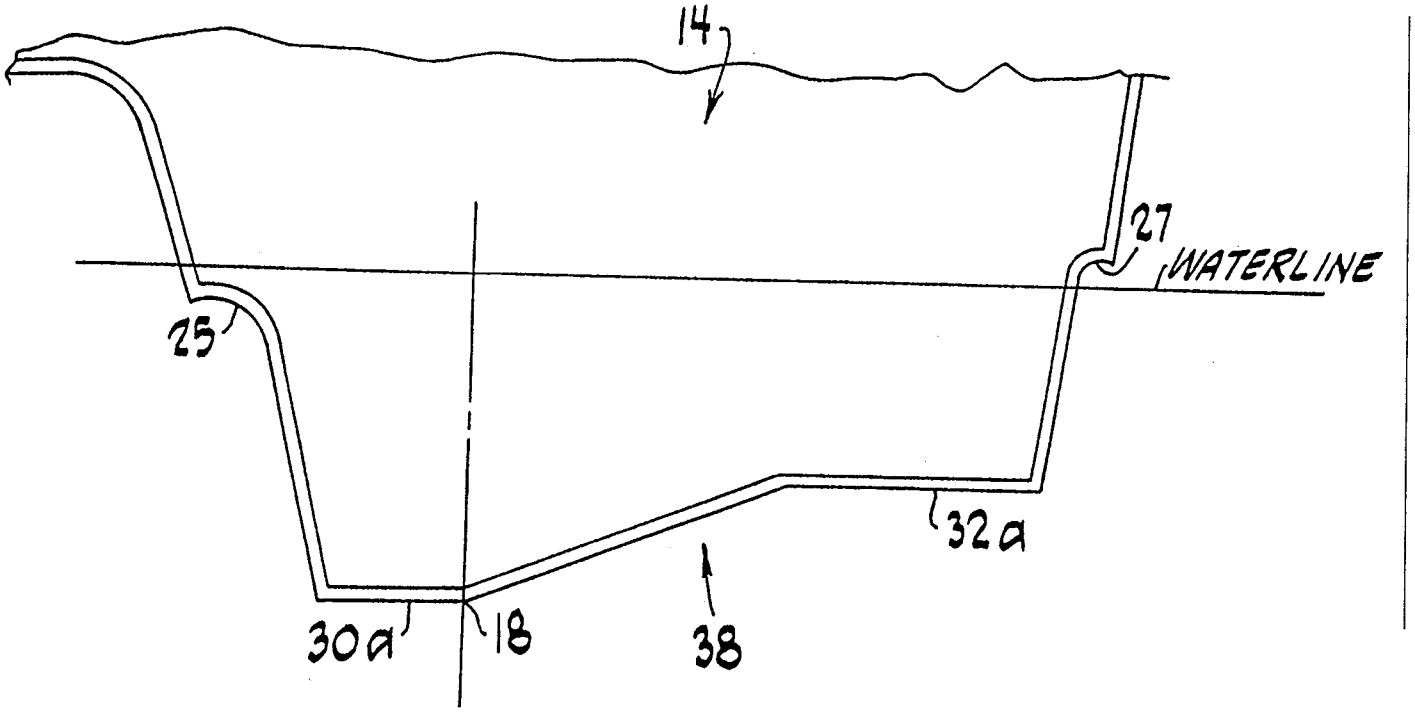

The chine and keel flats combined with a high deadrise section (preferably approximately 21°) create equivalent lift to a lower deadrise section. The bottom of the craft is divided into three separate planing areas: aft plane 34 (FIG. 9), mid plane 36 (FIG. 8) and fore plane 38 (FIGS. 6 and 7). The deadrise on each of these areas is different; being lower on the aft (preferably about 10° to 25°, and more preferably about 13° to 21°), 2½° to 4° greater on the mid and 2½° to 4° greater on the fore plane. The deadrise changes occur along lines 31*a* and 31*b*, defined by the step breaks. The aft 34 and mid 36 planes are dead constant in section in all elevations, there being no twist in these sections.

Transverse step breaks 40 and 42 in the bottom are used to separate the three planing areas. By providing separate planning areas, combined with the chine and keel flats, the craft has the equivalent of a very low deadrise in the aft planning areas. However, by changing the deadrise and reducing the chine and keel flats at each transverse step, the craft also achieves a very high deadrise effect amidships, with a perfect constant section leaving absolutely no twist or warp in the planning areas of the bottom. This means the craft has low deadrise in the aft and mid sections for high efficiency, higher speed, quicker planning. With no twist or warp in these sections the hull has a true constant section amidships, which gives more efficiency and fuller sections amidships to support the craft to carry weight forward efficiently and give a superior ride a following sea. Due to the deadrise changes effected through step breaks 40 and 42 and the reduction in the chine 32*c* and keel 30*c* flats, the fore plane areas have a high deadrise angle for a soft ride with minimal twist or warp, again for superior following sea performance. The chine 32 and keel 30 flats, in addition to the deadrise change effected by step breaks 40 and 42, give the effect of a lower deadrise in the aft 34 and mid 36 planes where the chines and flats (a and b) are immersed in water. The chines and keel flats (c) reduce in size quickly before amidships where they could come into contact with the surface water and cause slamming and a hard ride.

Both the tunnel shape and individual hull shape as described above are novel features of the present invention. However, the present invention is also the combination of the hull and tunnel shapes in a single multihull construction or catamaran. When combined into a single multihull construction these new features compliment each other for further enhanced performance. For example, the new hull shape alone according to the invention on a conventional high and wide catamaran tunnel would improve its performance. Likewise, the new tunnel shape alone according to the invention on a nonstepped, deep deadrise hull form would also provide an increase in performance and efficiency. The combination of the two features together provides a dramatic increase in performance and handling along with a lower narrower more pleasing profile due to the tunnel dimensions and far sleeker hull shape due to the hull shape offered by the multi constant deadrise step configuration with its natural sleek bow rake due to its high angle of attack.

EXAMPLE

The following example is given to further illustrate and describe the present invention. This example is given for illustrative and descriptive purposes only and the present invention should not be inferred to be limited by this example.

Referring to FIG. 1, it can be seen that the position of the first and second step breaks 40, 42 can be determined relative to the datum waterline. Dimensions A and B as approximate percentages of the datum waterline length are: A=51%; B=74.3%.

Figure 10:
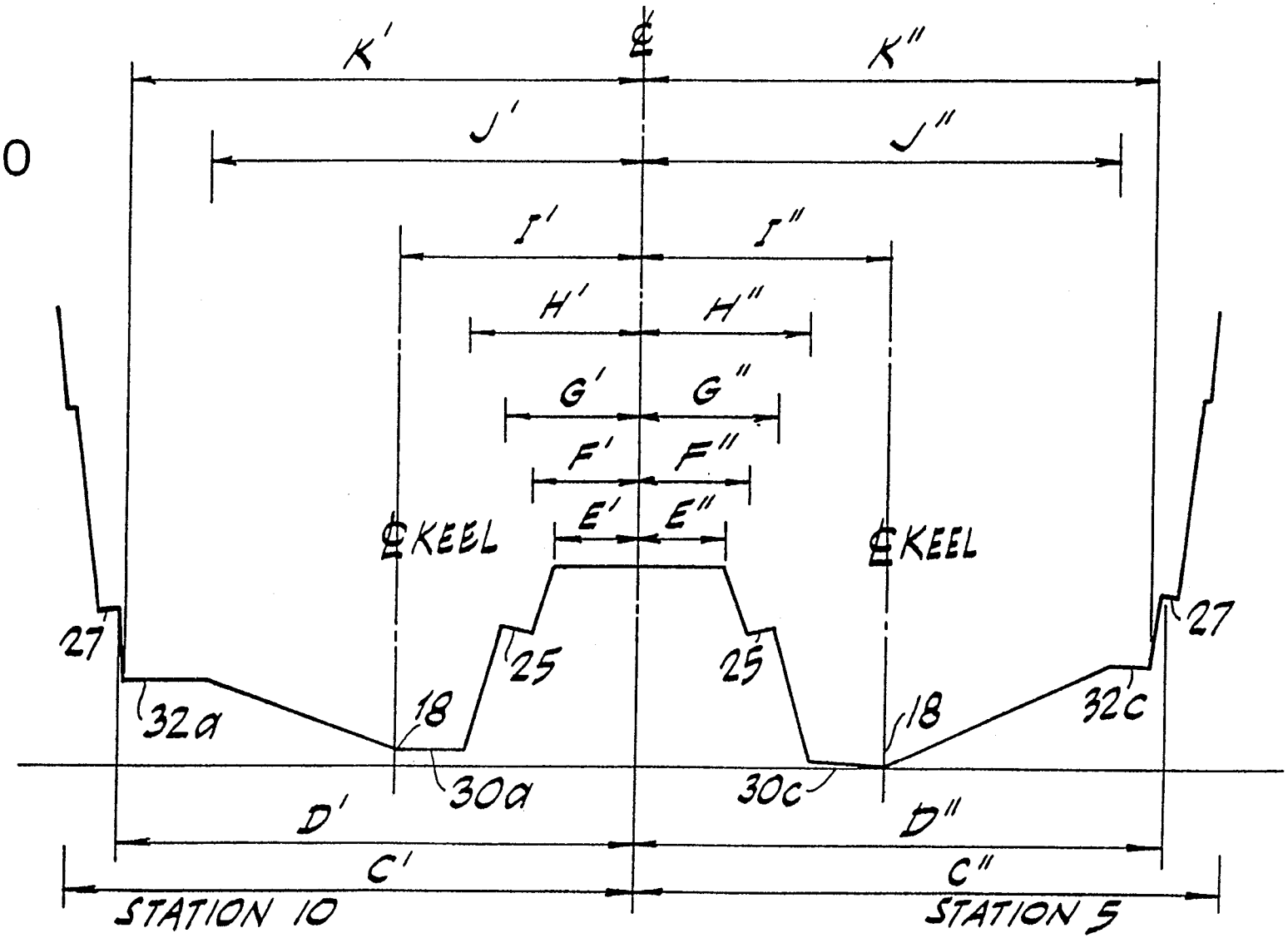
FIG. 10 is a schematic partial section view of the boat hull of the invention at lines 5—5 and 10—10 in FIG. 1, wherein line 5—5 indicates building station 5 and line 10—10 indicates building station 10.

FIG. 10 indicates relative dimensions of the hull cross-sections at building stations 5 and 10, shown in FIG. 1. Because the hull is symmetrical about the centerline, the dimensions for station 5 and station 10 are shown on the same figure for ease id comparison. C′ and C″ indicate the overall beam at the respective stations. D′ and D″ indicate the distance to the outer chine. In approximate percentages, D has the following values: D′=90.15 percent of C′; D″=87.47 percent of C″.

The remaining dimensions, E–K, are measured as approximate percentages of their respective D′ or D″. These dimensions are given below:

| | |
|---|---|
| E' = 16.3% | E'' = 16.4% |
| F' = 20.2% | F'' = 20.5% |
| G' = 26.4% | G'' = 26.5% |
| H' = 33.4% | H'' = 33.5% |
| I' = 47.5% | I'' = 47.5% |
| J' = 86.2% | J'' = 93.3% |
| K' = 99.3% | K'' = 99.3% |

With these relative dimensions and the description contained herein, a person of ordinary skill in the art could construct a boat hull according to the present invention in any desired size. By way of further example, in a nominal fifty foot hull according to the invention, the datum waterline length is about 11.2 meters, C' equals about 2.5 meters and C'' equals about 2.6 meters.

I claim:

1. A boat having two spaced-apart hulls, a boat body positioned on the hulls and a tunnel formed on three sides by such body and hulls and on a fourth and a bottom side by the water in which the boat is positioned, said tunnel defining a mouth at the bow of the boat and an exit at the stern; wherein:

the distance between the spaced apart hulls defines a tunnel width which decreases from the mouth to the exit;

the boat body defines a tunnel roof at a decreasing height above the waterline from the mouth to the exit;

each said hull comprises an aft planing section, a mid planing section and a fore planing section disposed one adjacent to the next from aft to forward along the hull, a first step break disposed between the aft and mid planing sections and a second step break disposed between the mid and fore planing sections;

the aft section defines first a constant deadrise angle and the mid section defines a second constant deadrise angle greater than the first constant deadrise angle such that the deadrise angle of said hull increases from aft through the mid sections without twist or warp; and the fore section defines at least a third deadrise angle greater than the first and second deadrise angles.

2. The boat according to claim 1 wherein the tunnel width at the mouth is approximately two times or more greater than the tunnel width at the exit.

3. The boat according to claim 1, wherein the tunnel width decreases from the mouth to amidships and is substantially constant from amidships to the exit.

4. The boat according to claim 3, wherein the tunnel height at the mouth is approximately two and one-half times or more greater than the height at the exit.

5. The boat according to claim 1, wherein:

each said hull defines an inboard portion and an outboard portion, said portions extending longitudinally along substantially the length of the hull;

each said planing section defines, along the outboard portion, a chine flat and, along the inboard portion, a keel flat;

the aft section chine flat extends from the transom, at a first width, to a location aft of the first step break, said width reducing therealong, and the mid section chine flat extends from the first step break, also at a first width, to a location aft of the second step break, also reducing said width therealong; and said fore section chine flat extends from the second step break forward.

6. The boat according to claim 5, wherein said aft section chine flat and said mid section chine flat reduce in width substantially to a point with substantially no width at said locations aft of the step breaks.

7. The boat according to claim 6, wherein said hull further defines at least two additional chine flats one disposed outboard of said planing section chine flats and one disposed inboard of said keel flats, both extending substantially along the length of the hull.

8. The boat according to claim 1, wherein the deadrise angle in the mid section is approximately 2½° to 4° greater than in the aft section and a further approximately 2½° to 4° greater in the fore section.

9. A boat hull, comprising an aft planing section, a mid planing section and a fore planing section disposed one adjacent to the next from aft to forward along the hull, a first step break disposed between the aft and mid planing sections, and a second step break disposed between the mid and fore planing sections, wherein:

the aft section defines first a constant deadrise angle and the mid section defines a second constant deadrise angle greater than the first constant deadrise angle such that the deadrise angle of said hull increases from aft through the mid sections without twist or warp; and the fore section defines at least a third deadrise angle greater than the first and second deadrise angles.

10. The boat hull according to claim 9, wherein:

said hull defines a first side portion and a second, opposite side outboard portion, said portions extending longitudinally along substantially the length of the hull;

each said planing section defines, along the second side portion, a chine flat and, along the first side portion, a keel flat;

the aft section chine flat extends from the transom, at a first width, to a location aft of the first step break, said width reducing therealong, and the mid section chine flat extends from the first step break, also a first width, to a location aft of the second step break, also reducing said width therealong; and said fore section chine flat extends from the second step break forward.

11. The boat hull according to claim 10, wherein said aft section chine flat and said mid section chine flat reduce in width substantially to a point with substantially no width at said locations aft of the step breaks.

12. The boat hull according to claim 11, wherein said hull further defines at least one additional chine flat disposed outwardly of said planing section chine flats and extending substantially along the length of the hull on the second side portion.

13. The boat hull according to claim 9, wherein the deadrise angle changes along lines defined by said step breaks.

14. A boat having two spaced-apart hulls, a boat body positioned on the hulls and a tunnel formed on three sides by such body and hulls and on a fourth and a bottom side by the water in which the boat is positioned, wherein:

each said hull comprises an aft planing section, a mid planing section and a fore planing section disposed one adjacent to the next from aft to forward along the hull, a first step break disposed between the aft and mid planing sections and a second step break disposed between the mid and fore planing sections, and each said hull defines an inboard portion and an outboard portion adjacent said tunnel, said portions extending longitudinally along substantially the length of each hull;

the aft section defines first a constant deadrise angle, a first chine flat along the outboard portion and a first keel flat along the inboard portion, with the first chine flat extending from the transom, at a predetermined width, to a location aft of the first step break, said width reducing therealong;

the mid section defines a second constant deadrise angle, a second chine flat along the outboard portion and a second keel flat along the inboard portion, with the second constant dead rise angle greater than the first constant deadrise angle such that the deadrise angle of said hull increases from the aft section through the mid section without twist or warp, the mid section chine flat extends from the first step break, at a predetermined width, to a location aft of the second step break, also reducing said width therealong;

the fore section defines at least a third deadrise angle, a third chine flat along the outboard portion and a third keel flat along the inboard portion, with the third deadrise angle greater than the first and second deadrise angles and the fore section chine flat extending from the second step break forward;

the distance between the spaced apart hulls defines a tunnel width which decreases from the bow to the stern; and the boat body defines a tunnel roof at a decreasing height above the waterline from the bow to the stern.

15. The boat according to claim 14, wherein the tunnel defines a mouth at the bow of the boat and an exit at the stern and the tunnel width at the mouth is approximately two times or more greater than the tunnel width at the exit.

16. The boat according to claim 15, wherein the tunnel height at the mouth is approximately two and one-half times or more greater than the height at the exit.

17. The boat hull according to claim 14, wherein said aft section chine flat and said mid section chine flat reduce in width substantially to a point with substantially no width at said locations aft of the step breaks.

18. A boat hull, comprising an aft planing section, a mid planing section and a fore planing section disposed one adjacent to the next from aft to forward along the hull, a first step break disposed between the aft and mid planing sections, and a second step break disposed between the mid and fore planing sections, wherein:

the aft section defines first a constant deadrise angle and the mid section defines a second constant deadrise angle greater than the first constant deadrise angle such that the deadrise angle of said hull increases from aft through the mid sections without twist or warp;

the fore section defines at least a third deadrise angle greater than the first and second deadrise angles;

said hull defines first side portion and a second, opposite side portion, said portions extending longitudinally along substantially the length of the hull;

each said planing section defines, along the second side portion, a chine flat and, along the first side portion, a keel flat;

the aft section chine flat extends from the transom, at a first width, to a location aft of the first step break, said width reducing therealong, and the mid section chine flat extends from the first step break, also a first width, to a location aft of the second step break, also reducing said width therealong; and said fore section chine flat extends from the second step break forward.

19. The boat hull according to claim 18, wherein said aft section chine flat and said mid section chine flat reduce in width substantially to a point with substantially no width at said locations aft of the step breaks.

20. The boat hull according to claim 19, wherein said hull further defines at least one additional chine flat disposed outwardly of said planing section chine flats and extending substantially along the length of the hull on said second side portion.

21. The boat hull according to claim 18, wherein the deadrise angle changes along lines defined by said step breaks.

22. A boat having two spaced-apart hulls, a boat body positioned on the hulls and a tunnel formed on three sides by such body and hulls and on a fourth and a bottom side by the water in which the boat is positioned, said tunnel defining a mouth at the bow of the boat and an exit at the stern, wherein the distance between the spaced apart hulls defines a tunnel width which decreases from the mouth to the exit and the boat body defines a tunnel roof at a decreasing height above the waterline from the mouth to the exit; and each hull having a keel and at least one inboard keel flat extending along each said keel and further comprising an inboard tunnel wall extending upwardly from the keel flat inboard of the respective keel flat to the tunnel roof, wherein said tunnel wall is angled inwardly such that the tunnel width narrows from the bottom side to the tunnel roof and each said tunnel wall comprises a first portion at a first angle separated from a second portion by a chine portion.

* * * * *